US009376887B2

(12) United States Patent
Bernard et al.

(10) Patent No.: US 9,376,887 B2
(45) Date of Patent: Jun. 28, 2016

(54) STUFFING BOX FOR A FLUID PRODUCTION WELL, AND ASSOCIATED SURFACE ASSEMBLY

(75) Inventors: Yvon Bernard, Roissy en France (FR); Pierre-Arnaud Foucher, Roissy en France (FR); Francois Girardi, Roissy en France (FR)

(73) Assignee: GEOSERVICES EQUIPMENTS, Roissy en France (FR)

( * ) Notice: Subject to any disclaimer, the term of this patent is extended or adjusted under 35 U.S.C. 154(b) by 709 days.

(21) Appl. No.: 13/695,047

(22) PCT Filed: Apr. 26, 2011

(86) PCT No.: PCT/EP2011/002079

§ 371 (c)(1), (2), (4) Date: Jan. 16, 2013

(87) PCT Pub. No.: WO2011/134637

PCT Pub. Date: Nov. 3, 2011

(65) Prior Publication Data

US 2013/0105141 A1 May 2, 2013

(30) Foreign Application Priority Data

Apr. 27, 2010 (FR) ..... 10 53206

(51) Int. Cl.

| | |
|---|---|
| ***E21B 33/03*** | (2006.01) |
| ***E21B 33/13*** | (2006.01) |
| ***E21B 33/072*** | (2006.01) |
| ***E21B 33/08*** | (2006.01) |

(52) U.S. Cl.

CPC ..... *E21B 33/13* (2013.01); *E21B 33/03* (2013.01); *E21B 33/072* (2013.01); *E21B 33/08* (2013.01)

(58) Field of Classification Search

CPC ..... E21B 33/072; E21B 33/076; E21B 33/03

See application file for complete search history.

(56) References Cited

U.S. PATENT DOCUMENTS

| | | | | |
|---|---|---|---|---|
| 3,145,995 | A * | 8/1964 | Adamson et al. | 166/53 |
| 3,424,247 | A | 1/1969 | Lee | |
| 3,481,610 | A | 12/1969 | Slator et al. | |
| 3,762,725 | A * | 10/1973 | Taylor | 277/330 |
| 3,831,676 | A * | 8/1974 | Brown et al. | 166/84.2 |
| 4,109,713 | A * | 8/1978 | Clow | 166/53 |

(Continued)

FOREIGN PATENT DOCUMENTS

GB 2418463 3/2006

OTHER PUBLICATIONS

First Examination Report issued in related AU application 2015255192 on Mar. 4, 2016, 3 pages.

*Primary Examiner* — Benjamin Fiorello

(57) ABSTRACT

This stuffing box (46) defines a circulation passage (66) of a cable working line (28), a packer (70), and a back-pressure resistant valve (74). The passage (66) extends between an upstream end (62) of the stuffing box (46), intended to be connected to a well, and a downstream end (64). The back-pressure resistant valve (74) is arranged in the passage (66) to prevent, in case of break of the line (28), the back-pressure of a fluid from the upstream end (62) towards the downstream end (64). The or each packer (70) is situated between the upstream end (62) of the stuffing box (46) and the back-pressure resistant valve (74). No packer (70) is arranged between the back-pressure resistant valve (74) and the downstream end (64).

19 Claims, 2 Drawing Sheets

(56) References Cited

U.S. PATENT DOCUMENTS 4,266,605 A * 5/1981 LaBorde et al. ..... 166/97.1
4,442,859 A * 4/1984 Gentry ..... 137/242
5,086,802 A * 2/1992 Spears ..... 137/68.11
7,652,592 B2 1/2010 Le Briere et al.
8,091,629 B2 * 1/2012 Fogg et al. ..... 166/77.1

* cited by examiner

STUFFING BOX FOR A FLUID PRODUCTION WELL, AND ASSOCIATED SURFACE ASSEMBLY

FIELD OF THE DISCLOSURE

The present disclosure concerns a stuffing box for a fluid production well and, in particular, concern a stuffing box having strategically located packers.

BACKGROUND OF THE DISCLOSURE

Stuffing boxes are typically define a circulation passage of a cable working line extending between an upstream end of the stuffing box, intended to be connected to the well, and a downstream end. The stuffing box usually includes at least one packer arranged in the passage to ensure the sealing between an upstream portion and a downstream portion of the passage when the line is inserted in the passage. The stuffing box further includes a back-pressure resistant valve arranged in the passage to prevent, in case of break of the line, the back-pressure of a fluid from the upstream end towards the downstream end. Such a stuffing box is generally part of pressure control equipment, intended to be mounted on the wellhead. The pressure control equipment thus generally comprise, from bottom to top, a device for preventing back-pressure of the fluid contained in the well (designated by the term "Blow Off Preventer," or BOP), a lock, and the stuffing box.

The aforementioned equipment ensures the safe passage of operating tools deployed in the well by a cable working line between the atmospheric pressure reigning outside the well and the internal pressure of the well when an operation is necessary in the well. Such control equipment is used for fluid production wells, such as hydrocarbon production wells such as oil or natural gas, or for injector wells. It is essential to ensure the surface safety of operations in the well. The lock allows objects to be introduced in the well. The stuffing box is arranged above the lock to ensure sealing around the cable working line, and orient the cable working line in the well with the aid of a return pulley.

The stuffing box comprises a hollow vertical body through which the cable working line passes and which ensures the sealing between the upper part of the lock, subjected to the pressure from the well, and the outside subject to the atmospheric pressure. To that end, the sealing is done by annular rubber packer elements that are annularly applied around the cable, between a fixed lower stop and an adjustable upper stop, adjustable for example using a piston. To unwind the cable working line, it is known to use a drawworks, which is brought near the well and maneuvered in rotation to wind or unwind the line in the well.

The cable working lines generally used in particular include single-strand smooth cables, of the "piano wire" or "slickline" type. These lines make it possible to perform various mechanical operations (commonly called "cable operations") at the bottom of the well, such as opening and closing valves, placing elements or tools, or perforating a wall. The cable working lines used can also be electrically insulated cables, of the "Gemline" type.

It does, however, happen that the cable working line breaks and completely leaves the stuffing box. The stuffing box no longer ensures sealing and there is then a risk of fluid discharge from the well into the environment. In order to prevent such a discharge, stuffing boxes are generally equipped with a back-pressure resistant valve.

In the known stuffing boxes, the back-pressure resistant valve is generally situated between the packer elements and the end of the stuffing box connected to the well. This results in crushing of the valve, which sometimes prevents it from performing its function.

On the other hand, in the known stuffing boxes, the back-pressure resistant valve is generally a ball valve. The valve defines a housing in which the ball rests during normal time. A pipe emerges in the bottom of said housing and in the circulation passage of the cable working line.

Thus, when the cable working line breaks, the pressure increases in the passage under the effect of the fluid coming from the well. This pressure increase is passed on at the bottom of the housing through the pipe, which causes the ball to be ejected outside the housing. The ball then obstructs the passage, thereby ensuring sealing between the upper part of the lock and the atmospheric pressure.

Such a device is not, however, fully satisfactory. Indeed, the pipe forms a dead space in which impurities are deposited. It thus occurs that impurities block the pipe, which blocks the operation of the valve.

One aim of the disclosure is therefore to propose a stuffing box with a more reliable operation than the known stuffing boxes.

SUMMARY OF THE DISCLOSURE

Accordingly to one exemplary embodiment, a stuffing box includes a packer situated between the upstream end of a stuffing box and a back-pressure resistant valve, with no packer being arranged between the back-pressure resistant valve and the downstream end. The stuffing box can comprise one or several of the following features, considered alone or according to all technically possible combinations:

- the stuffing box comprises a compression piston for compressing at least one packer, the piston defining a channel forming a portion of the passage;
- the back-pressure resistant valve includes a ball and a seat defining a part of the passage, the back-pressure resistant valve defining a housing for receiving the ball, the ball of the valve being mobile between an idle position, in which the ball is arranged spaced away from the seat, in the housing, and a blocking position of the passage, in which the ball is arranged in the seat, outside the housing, to completely obstruct the passage;
- the seat has a tapered downstream surface to receive the ball in the blocking position of the passage;
- in the idle position, the ball protrudes partially outside the housing, in the passage;
- the passage has a bottom defined by a solid wall, the housing emerging exclusively in the passage;
- the passage generally widens, moving from upstream to downstream from at least one packer towards the downstream end of the stuffing box;
- the stuffing box includes an anti-extrusion ring inserted between the back-pressure resistant valve and at least one packer;
- the anti-extrusion ring has an upstream face and a downstream face and includes, in its center, a through opening emerging in the upstream and downstream faces of the anti-extrusion ring, the through opening including a tapered portion widened towards the downstream and emerging in the downstream face of the anti-extrusion ring;
- the stuffing box includes a lubrication ring inserted between the upstream end and at least one packer, the lubrication ring including at least one hole calibrated for injecting lubricant in the passage; and the stuffing box includes a hollow shaft for receiving the or each packer and an outer cover for receiving the back-pressure resistant valve, the outer cover being connected to the hollow shaft by a deformable member wedged between the hollow shaft and the outer cover.

Accordingly to another exemplary embodiment, surface equipment for a fluid production well is disclosed. The surface equipment includes a wellhead intended to cover the well towards the top; a stuffing box as described above, a device for operating in the well that includes a cable working line introduced into the well through the stuffing box and the wellhead; and a drawworks for deploying the cable working line.

Accordingly to another exemplary embodiment, a stuffing box for a fluid production well is disclosed. The stuffing box includes a passage extending between an upstream end and a downstream end of the stuffing box for receiving a cable working line, a back-pressure resistant valve disposed in the passage, and one or more one packers disposed in the passage between the back-pressure resistant valve and the upstream end.

BRIEF DESCRIPTION OF THE DRAWINGS

The present disclosure will be better understood upon reading the following description and done in reference to the appended drawings, in which.

DETAILED DESCRIPTION OF THE DISCLOSURE

Figure 1:
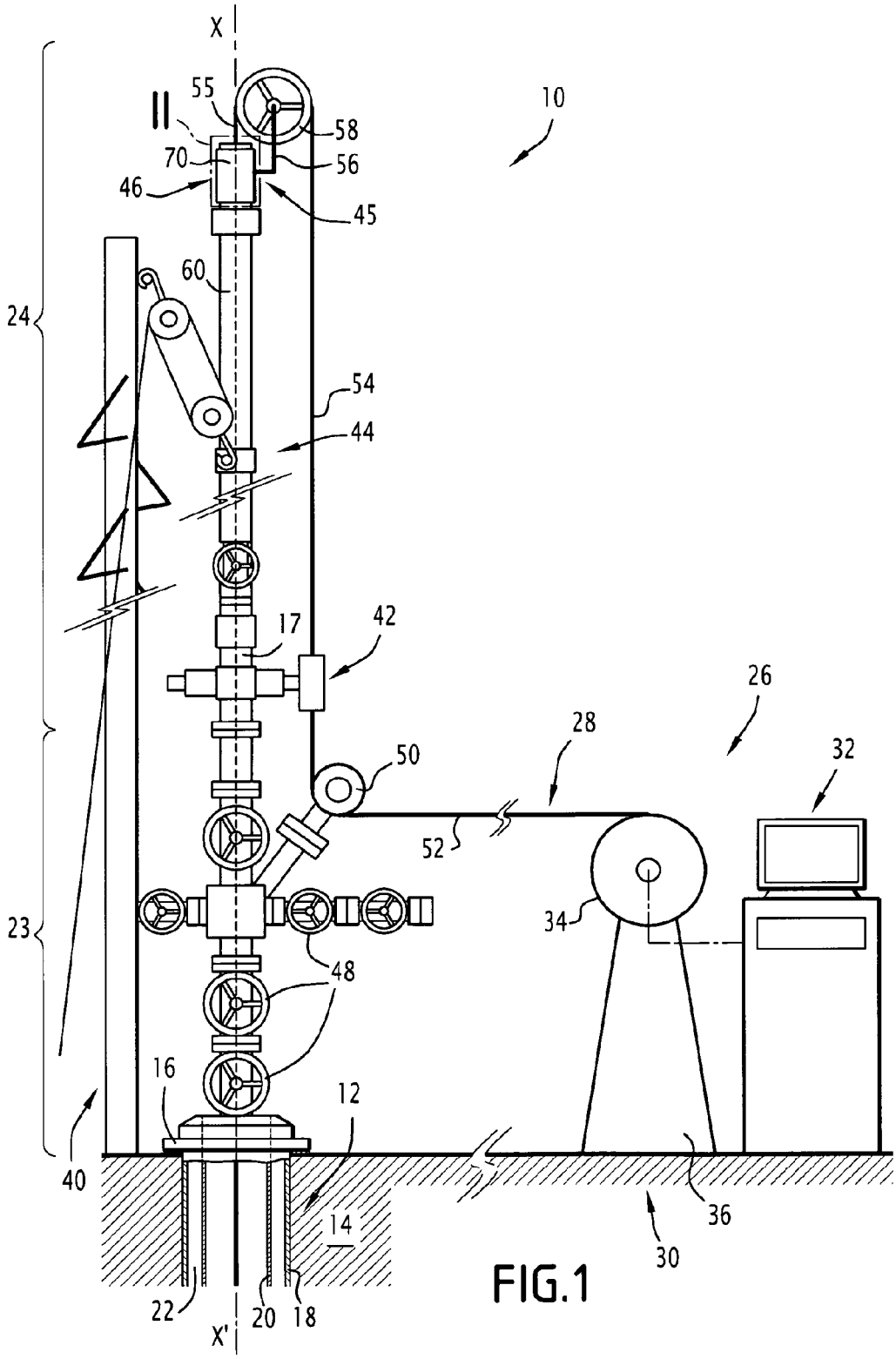
FIG. 1 is an elevation and partial cross-sectional view of surface equipment according to the disclosure.
Figure 2:
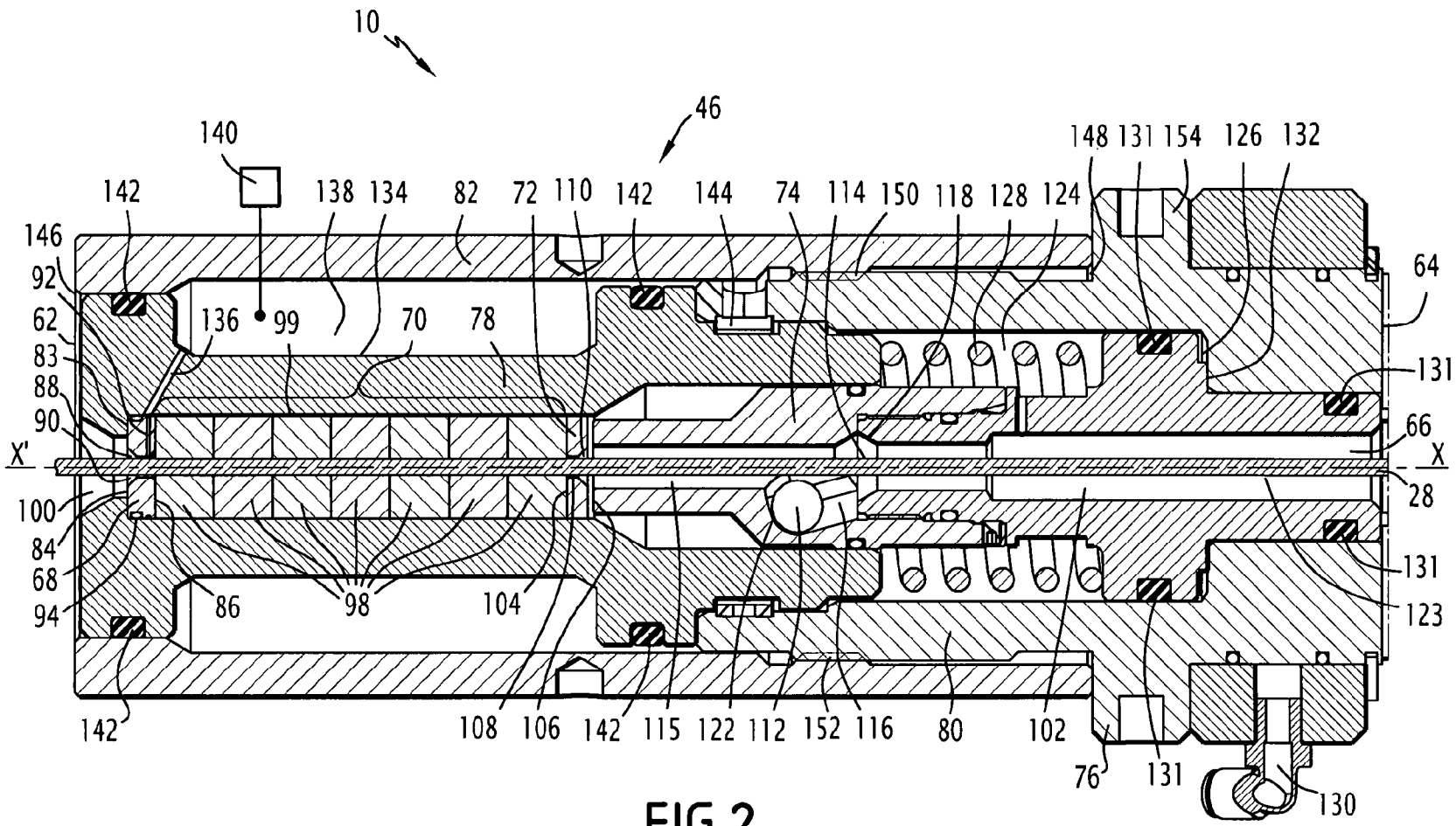
FIG. 2 is a cross-section of a detail marked II in FIG. 1, showing a stuffing box according to the disclosure.

FIGS. 1 and 2 show a surface assembly 10 for a fluid production well 12 according to the disclosure. The well 12 is intended to produce or receive one or several fluids, in particular hydrocarbons such as oil and natural gas or another effluent such as vapor or water.

As illustrated by FIG. 1, and traditionally, the well 12 is formed in the ground 14 to connect a layer of fluid (not shown) situated in the subsoil to a surface point 16. Traditionally, the well 12 comprises at least one outer pipe called a casing line 18 and at least one inner pipe called a production pipe 20 mounted in the casing line 18 to collect the fluid extracted from the layer and convey it to the surface. The pipes 18, 20 define an annular space 22 between them. The surface assembly 10 comprises a wellhead 23, pressure control equipment 24 mounted on the wellhead, and an operating device 26 for performing operations in the well 12. The intervention device 26 comprises a cable working line 28, a drawworks 30 for deploying and withdrawing the line 28, and a control and measuring unit 32, to control the operation.

In the example illustrated in FIGS. 1 and 2, the line 28 comprises a single-strand smooth cable of the "piano wire" or "slickline" type. It is made from a metal material, such as galvanized or stainless steel (for example type 316). This smooth cable has a good tensile strength and suitable flexibility. Typically, this type of cable has a breaking load of 300 DaN to 1500 DaN, preferably from 600 to 1000 DaN. It has a length greater than 1000 meters and generally between 3000 meters and 10,000 meters depending on the depth of the well. The diameter of the smooth cable 28 is adapted to introduce it through the equipment 24. Typically, the diameter of cables of this type is between 1 mm and 5 mm, preferably between 1.5 mm and 4 mm. Alternatively, the line 28 comprises a single-strand smooth cable provided with an outer electrically insulating coating, as described in French application FR-A-2 848 363 by the Applicant.

In another alternative, the line 28 comprises a stranded electrical cable comprising a conductor and having a diameter of up to 8 mm. The drawworks 30 comprises a drum 34 rotating around a horizontal axis, and a motor 36 for driving the rotation of the drum 34 around its axis. The line 28 is wound partially around the drum 34. The motor 36 is hydraulically connected to the control unit 32 to selectively drive the rotation of the drum 34 around its axis in a first direction or in a second direction, to unwind or wind the line 28 on the drum. The drum 34 is mechanically connected to the unit 32 by brakes.

The pressure control equipment 24 comprises, from bottom to top from the wellhead 23, a blow off preventer 42, a lock 44 for introducing the object into the well 12, and above the lock 44, a return assembly 45 and a stuffing box 46 according to the disclosure. The blow off preventer 42, the lock 44 and the stuffing box 46 inwardly define a continuous pipe 47 for passage of the smooth cable, with a vertical axis X-X', which emerges in the wellhead 23 to be connected to the well 12 at the point 16. The smooth cable 28 circulates through the pipe 47. The wellhead 23 protrudes vertically from the first point 16, it comprises a set of selective closure valves 48 of the casing line 18, the production tube 20 and the annular space 22, to allow the introduction and extraction of fluid present in any one of said elements 18, 20, 22.

A lower return pulley 50 of the line 28, which extends opposite the drum 34 substantially at the same height as the drum 34, is fastened on the well head 23. The line 28 is wound around the pulley 50 and defines a first substantially horizontal section 52 extending between the drum 34 and the pulley 50 and a second substantially vertical section 54 extending upwards from the pulley 50 parallel to the preventer 42 and the lock 44 up to the return assembly 45. The return assembly 34 comprises a pulley support 56, an upper return pulley 58 rotatingly mounted around a horizontal axis in the support 56 and rollers (not shown) for keeping the line 28 against the pulley 58. The support 56 is rotatingly mounted on the stuffing box 46 around the axis X-X'. The line 28 is wound around the pulley 58 and defines a third substantially vertical section 55 extending downwards from the return wheel 45 to the stuffing box 46.

As is known in itself, the blow off preventer 42 comprises shutters (not shown) comprising jaws whereof the purpose is to prevent or control an eruption, i.e. to selectively close or open the well. The preventer 42 thus comprises a jaw (not shown) enabling gripping around the line 28 in order to ensure sealing around the line 28, and a jaw (not shown) for shearing the line 28 in case of extreme emergency and thus covering the vertical cavity 47 for circulation of the cable and preventing the eruption of the fluid contained in the well 12. The preventer 42 is fastened on the wellhead 23 in the vertical axis X-X' of the head 23. The lock 44 comprises a plurality of tubular elements 60 mounted above the device 42 along the axis X-X'. The tubular elements 60 have a length for example between 1.5 m and 2.5 m and are connected via quick connectors provided with o-ring seals. A bleed valve is provided in the bottom of the lock 44 to bleed it when the shutter of the wellhead 23 is closed.

The stuffing box 46 is oriented substantially vertically, along the axis X-X'. In reference to FIG. 2, it has an upstream end 62, connected to the upper portion of the lock 44, oriented downwards and a downstream end 64, oriented upwards. The stuffing box 46 defines an inner passage 66 for circulation of the line 28. The stuffing box 46 comprises, from upstream to downstream, a lubrication ring 68, a packer 70, an anti-extrusion ring 72, a check valve 74 and a piston 76. The lubrication ring 68, the packer 70 and the anti-extrusion ring 72 are completely housed in a tubular hollow shaft 78. The check valve 74 and the piston 76 are housed in a tubular outer cover 80. A protective body 82 receives the hollow shaft 78 and part of the outer cover 80.

The passage 66 forms part of the pipe 47. It extends substantially axially between the upstream 62 and downstream 64 ends of the stuffing box 46. The passage 66 widens generally, moving from upstream to downstream, from the packer 70 towards the downstream end 64 of the stuffing box 46. The lubrication ring 68 is arranged in the hollow shaft 78, between a bearing rim 83 of the hollow shaft 78 and the packer 70. The lubrication ring 68 has an upper face 84 bearing against the rim 83 and a downstream face 86 in contact with the packer 70. The lubrication ring 68 has, in its center, a through opening 88, emerging in the upstream 84 and downstream 86 faces. The through opening 88 comprises a tapered portion 90 widened towards the upstream direction and emerging in the upstream face 84. The through opening 88 forms part of the passage 66.

The lubrication ring 68 also includes calibrated holes 92 for injecting lubricant in the passage 66. The calibrated holes 92 are oriented substantially radially relative to the passage 66. They emerge in the passage 66 and in an outer peripheral face 94 of the lubrication ring 68. They have a diameter for example between 0.3 mm and 0.7 mm to allow a drop lubrication flow of the lubricant in the passage 66. The lubrication ring 68 has a thickness advantageously smaller than 3 mm, which limits the risks of jamming of the line 28 by impurities.

The packer 70 is situated between the upstream end 62 and the valve 74. It comprises several annular packers 98, generally between 1 and 10. The packers 98 are arranged along the axis X-X' in the hollow shaft 78 around the line 28, between the lubrication ring 68 and the anti-extrusion ring 72. Each packer 98 is axially compressible, along the axis X-X', between the piston 76 and the bearing rim 83, to allow radial expansion between the line 28 and an inner surface 99 of the hollow shaft 78. The successive packers 98 are applied against each other so that they do not define dead spaces between them. No equipment or mechanism is inserted between the successive packers 98. When the line 28 is introduced in the packer 70, and when the packer 70 is kept in axial compression between the piston 76 and the bearing rim 83, the packer 70 sealably separates an upstream portion 100 from a downstream portion 102 of the passage 66. The upstream portion 100 extends in the hollow shaft 78, upstream of the lubrication ring 68. The downstream portion 102 extends in the piston 76. Thus, the pressure that reigns in the upstream portion 100 of the passage 66 is kept substantially equal to the pressure of the well 12, while the pressure that reigns downstream of the packer 70 is substantially equal to the surface pressure.

The anti-extrusion ring 72 is arranged in the hollow shaft 78, between the packer 70 and the valve 74. The anti-extrusion ring 72 has an upstream face 104 placed bearing against the packer 70 and a downstream face 106 arranged in contact with the valve 74. It includes, in its center, a through opening 108, emerging in the upstream 104 and downstream 106 faces. The through opening 108 comprises a tapered portion 110 wider towards the downstream direction and emerging in the downstream face 106. The through opening 108 forms part of the passage 66. The anti-extrusion ring 72 has a thickness smaller than 3 mm, which limits the risks of jamming of the line 28 by impurities. The inner diameter of the through opening 108 at the upstream face 104 is substantially equal to the inner diameter of the packers 98. This diameter is for example between 4 and 5 mm. Thus, the anti-extrusion ring 72 prevents the extrusion of packers 98 when they are axially compressed between the bearing rim 83 and the piston 76.

The valve 74 is positioned between the anti-extrusion ring 72 and the piston 76. It is partially arranged inside the hollow shaft 78. It is situated completely downstream from the packer 70. No packer 70 being applied on the line 28 is arranged between the valve 74 and the downstream end 64 of the stuffing box 46, downstream of the valve 74. In this example, the valve 74 includes a ball 112, as well as a seat 114 defining a part of the passage 66. The valve 74 also has a central lumen 115 forming part of the passage 66 and defines a lateral housing 116 for receiving the ball 112. The ball 112 is mounted mobile between an idle position and a blocking position of the passage 66. In the idle position, the ball 112 is arranged away from the seat 114, in the housing 116. It protrudes partially outside the housing 116, exceeding transversely in the pipe 66. In the blocking position, the ball 112 is applied against the seat 114, outside the housing 116, and completely covers the passage 66. It sealably separates the upstream 100 and downstream 102 parts of the passage 66.

The seat 114 comprises a tapered downstream surface 118 flared towards the upstream direction. The downstream tapered surface 118 has an upstream end, with an inner diameter greater than the diameter of the ball 112, and a downstream end, with an inner diameter smaller than the diameter of the ball 112 and equal to the diameter of the central lumen. The central lumen 115 extends substantially axially along the axis X-X'. It is cylindrical, with a diameter larger than the inner diameter of the packers 98. Its diameter is for example between 9 mm and 11 mm.

The housing 116 has a bottom 122 defined by a solid wall, without an opening. The housing 116 extends along an axis inclined relative to the axis X-X'. It emerges exclusively in the passage 66. The housing 116 is arranged to guide the ball 112 from its idle position to its blocking position. It is also arranged such that in the idle position, the ball 112 protrudes partially outside the housing 116, transversely in the passage 66. Thus, in the event the line 28 breaks, the ball 112 is directly driven from its idle position towards its blocking position by the pressurized fluid rising in the central lumen 115.

Alternatively, the closing function of the passage 66 by the valve 74 is not ensured by the ball 112, but by a deformable ring. To that end, the valve 74 includes, instead of the ball 112 and its housing 116, a deformable ring, for example made of rubber, arranged in the passage 66. The deformable ring is formed by a ring in a deformable material defined by an outer edge and by a free inner edge. The outer edge is integral with a wall of the passage 66. The deformable ring is deformable between an idle position and a blocking position of the passage 66. In the idle position, the ring extends generally axially, in the extension of its outer edge, towards the upstream direction. The free edge defines a central opening large enough to allow the passage of the line 28. In the blocking position, the free edge is applied against itself. The central opening is closed. The deformable ring covers the passage 66. It sealably separates the upstream 100 and downstream 102 parts of the passage 66.

In case of a break of the line 28, the pressure exerted by the pressurized fluid rising back up in the passage 66 on the deformable ring causes the deformation of the ring and pressing of the edge against itself, obstructing the passage 66. The piston 76 is arranged between the valve 74 and the downstream end 64 of the stuffing box 46. It is integral with the valve 74. It defines a central channel 123 forming the downstream part 102 of the passage 66. It outwardly defines, with the outer cover 80, a first upstream cavity 124 and a second downstream cavity 126 sealably separated.

The channel 123 extends substantially axially and crosses through the piston 73. The channel 123 has a diameter larger than the diameter of the central lumen 115. The diameter of the channel 123 is for example between 12 mm and 16 mm. The channel 123 forms the downstream part 102 of the passage 66. Thus, as seen above, the diameter of the passage 66 receiving the line 28 generally widens from upstream to downstream, the inner diameter of the packer 70 being smaller than the inner diameter of the central lumen 115, itself being smaller than the inner diameter of the channel 123. Dead spaces are thus minimized.

The first cavity 124 contains a return spring 128 inserted between the hollow shaft 78 and the piston 76. The second cavity 126 can contain a hydraulic fluid injected by a bleed 130 formed in the outer cover 80. The sealing between the second cavity 126 and the first cavity 124, on one hand, and between the second cavity 126 and the outside, on the other hand, in order to avoid leaks of hydraulic fluid, is ensured by annular joints 131. The piston 76 is axially mobile between an inactive position, in which it is arranged bearing against an upper wall 132 of the outer cover 80, and a compression position of the packer 70, under the action of the hydraulic fluid injected by the bleed 130. The return spring 128 continuously stresses the piston 76 towards its inactive position against the wall 132. The hollow shaft 78 has an outer face 134 situated opposite its inner face 99. It comprises through orifices 136 for intake of lubricant, emerging in the outer face 134 and in the inner face 99, opposite the calibrated holes 92 for injection of the lubricant of the lubrication ring 68. The outer face 134 of the hollow shaft 78 defines, with the protective body 82, a reservoir 138 of lubricant, supplied by injection means 140 for injecting lubricant. Joints 142 ensure the sealing between the hollow shaft 78 and the body 82. Thus, lubricant can be continuously injected from the injection means 140 in the reservoir 138, then through the orifices 136 and the calibrated holes 92 to be applied on the line 28, between the line 28 and the sealing elements 98.

The hollow shaft 78 is fastened on the outer body 80. It is connected to the outer body 80 by a deformable member 144 wedged between the outer wall 134 of the hollow shaft 78 and an inner wall of the outer cover 80. The deformable member 144 is for example annular and forms a ring. The outer cover 80 defines the downstream end 64 of the stuffing box 46. The protective body 82 is tubular. It has an upstream opening 146 and a downstream opening 148, both substantially circular. It includes an inner tapping 150 that collaborates with a thread 152 of the outer cover 80 to keep the outer cover 80 integral with the protective body 82. The upstream end 146 defines the upstream end 62 of the stuffing box 46. The hollow shaft 78 is flush with the upstream opening 146 and partially covers the upstream opening 146.

A shoulder 154 of the outer cover 80 is applied against the edge of the downstream opening 148. The placement and operation of the stuffing box 46 will now be described during a cable operation in the well 12. Initially, the wellhead 23 covers the fluid production well 12 sealably. The stuffing box 46 is provided and is mounted above the lock 44 of the surface assembly 10 of the well 12. It is installed substantially vertically, so that its upstream end 62 is oriented towards the well 12.

The cable working line 28 of the surface assembly 10 is engaged on the pulleys, then is introduced into the passage 66 of the stuffing box 46, from its downstream end 64 towards its upstream end 62. The line 28 then completely passes through the stuffing box 46, successively through the channel 123, the lumen 115 and the packer 70. Hydraulic fluid is then injected by the bleed 130 in the second cavity 126. Under the action of this hydraulic fluid gradually filing the second cavity 126, the piston 76, which is kept in its inactive position by the spring 128, moves axially downwards from its inactive position towards its compression position of the packer 70. The packers 98 are then compressed axially and expand radially between the line 28 and the inner surface 99 of the hollow shaft 78 to be applied on the line 28 and on the inner surface 99. The packer 70 then sealably separates the upstream 100 and downstream 102 portions of the passage 66.

A bottom tool is then introduced into the lock 44 and is connected to the lower end of the line 28. The lock 44 is then hermetically closed so as to insulate it from the outside. Then the wellhead 23 is opened to pass the tool and the line 28 is introduced into the well 12. The lock 44 and the upstream end 62 of the stuffing box 46 are then subject to the pressure reigning in the well 12. The pressure in the upstream part 100 is then substantially equal to the pressure in the well 12. The packer 70 ensures sealing between the upstream 100 and downstream 102 portions and prevents the pressured fluid contained in the well 12 from exiting to the outside. The line 28 can be lowered in the well 12, then raised, depending on the operations to be performed in the well 12.

In the case where the line 28 breaks, it completely leaves the stuffing box 46. The packer 70 then no longer ensures sealing and the fluid contained in the well 12 begins to rise in the stuffing box 46. A stream of fluid is created in the passage 66 of the stuffing box 46, from upstream to downstream. The ball 112 of the valve 74 partially protruding outside the housing 116, in the passage 66, is driven in the downstream direction by the fluid until it abuts against the seat 114. The ball 112 is then locked against the seat 114. The inner diameter of the downstream end of the tapered downstream surface 118 of the seat 114 being smaller than the diameter of the ball 112, the ball 112 then completely covers the passage 66, blocking the rise of the fluid contained in the well 12. The pressure in the passage 66, upstream of the ball 112, is substantially equal to the pressure inside the well 12 and keeps the ball 112 pressed against the seat 114. The valve 74 then ensures the sealing between the upstream 100 and downstream 102 portions of the passage 66, preventing the discharge of fluid contained in the well 12 outside the well 12.

The stuffing box described above includes an intake system for lubricant upstream of the packer. However, the stuffing box according to the disclosure can also have such a lubricant intake system located downstream of the packer, for example by replacing the anti-extrusion ring or downstream therefrom. More generally, other mechanisms can be attached downstream of the assembly formed by the sealing elements 98 and the anti-extrusion rings. However, the diameter of the passage 66 widens gradually from upstream to downstream through the mechanisms to prevent the creation of dead spaces. In this case, the assembly formed by the sealing elements 98 and the anti-extrusion rings is advantageously located as close as possible to the upstream end 62.

Owing to the disclosure just described, the reliability of the check valve of the stuffing box is improved. Indeed, being insulated from the well by the packer, the check valve is not directly subjected to the action of the fluids from the well and is therefore less subject to soiling. Moreover, the stuffing box includes very little dead space where impurities are likely to accumulate. Since the ball of the valve protrudes slightly outside its housing, it is directly driven towards its blocking position of the passage by the fluid rising in the passage, without it being necessary to use a connected pipe likely to become plugged up.

The invention claimed is:

1. A stuffing box for a fluid production well, the stuffing box defining a circulation passage of a cable working line extending between an upstream end of the stuffing box, configured to be connected to the well, and a downstream end, the stuffing box including at least one packer arranged in the passage to ensure the sealing between an upstream portion and a downstream portion of the passage when the line is inserted in the passage, the stuffing box including a back-pressure resistant valve arranged in the passage to prevent, in case of break of the line, the back-pressure of a fluid from the upstream end towards the downstream end, wherein the or each packer is situated between the upstream end of the stuffing box and the back-pressure resistant valve, no packer being arranged between the back-pressure resistant valve and the downstream end.

2. The stuffing box according to claim 1, further comprising a compression piston for compressing at least one packer, the piston defining a channel forming a portion of the passage.

3. The stuffing box according to claim 1, wherein the back-pressure resistant valve includes a ball and a seat defining a part of the passage, the back-pressure resistant valve defining a housing for receiving the ball, the ball of the valve being mobile between an idle position, in which the ball is arranged spaced away from the seat, in the housing, and a blocking position of the passage, in which the ball is arranged in the seat, outside the housing, to completely obstruct the passage.

4. The stuffing box according to claim 3, wherein that the seat has a tapered downstream surface to receive the ball in the blocking position of the passage.

5. The stuffing box according to claim 3, wherein in the idle position, the ball protrudes partially outside the housing, in the passage.

6. The stuffing box according to claim 3, wherein that the housing has a bottom defined by a solid wall, the housing emerging exclusively in the passage.

7. The stuffing box according to claim 1, wherein the passage generally widens, moving from upstream to downstream from at least one packer towards the downstream end of the stuffing box.

8. The stuffing box according to claim 1, further comprising an anti-extrusion ring inserted between the back-pressure resistant valve and at least one packer.

9. The stuffing box according to claim 8, wherein that the anti-extrusion ring has an upstream face and a downstream face and includes, in its center, a through opening emerging in the upstream and downstream faces of the anti-extrusion ring, the through opening including a tapered portion widened towards the downstream and emerging in the downstream face of the anti-extrusion ring.

10. The stuffing box according to claim 1, characterized further comprising a lubrication ring inserted between the upstream end and at least one packer, the lubrication ring including at least one hole calibrated for injecting lubricant in the passage.

11. The stuffing box according to claim 1, characterized further comprising a hollow shaft for receiving the or each packer and an outer cover for receiving the back-pressure resistant valve, the outer cover being connected to the hollow shaft by a deformable member wedged between the hollow shaft and the outer cover.

12. A surface assembly for a fluid production well, comprising:

a wellhead configured to cover the well towards the top;

the stuffing box according to claim 1; and a device for operating in the well, including:

a cable working line introduced into the well through the stuffing box and the wellhead; and a drawworks for deploying the cable working line.

13. The surface assembly of claim 12, wherein the stuffing box further comprises a compression piston for compressing at least one packer, the piston defining a channel forming a portion of the passage.

14. The surface assembly of claim 12, wherein the back-pressure resistant valve includes a ball and a seat defining a part of the passage, the back-pressure resistant valve defining a housing for receiving the ball, the ball of the valve being mobile between an idle position, in which the ball is arranged spaced away from the seat, in the housing, and a blocking position of the passage, in which the ball is arranged in the seat, outside the housing, to completely obstruct the passage.

15. The surface assembly of claim 14, wherein that the seat has a tapered downstream surface to receive the ball in the blocking position of the passage.

16. The surface assembly of claim 14, wherein in the idle position, the ball protrudes partially outside the housing, in the passage.

17. The surface assembly of claim 14, wherein the housing has a bottom defined by a solid wall, the housing emerging exclusively in the passage.

18. The surface assembly of claim 12, wherein the passage generally widens, moving from upstream to downstream from at least one packer towards the downstream end of the stuffing box.

19. The surface assembly of claim 12, wherein the stuffing box further comprises an anti-extrusion ring inserted between the back-pressure resistant valve and at least one packer.

* * * * *